US005191981A

United States Patent [19]

Young

[11] Patent Number: 5,191,981

[45] Date of Patent: Mar. 9, 1993

[54] SPECIFIC GRAVITY METAL SEPARATOR

[76] Inventor: Frederick W. Young, 122 Wilder St., Niceville, Fla. 32578

[21] Appl. No.: 801,411

[22] Filed: Dec. 2, 1991

[51] Int. Cl.[5] ..... B03C 1/30

[52] U.S. Cl. ..... 209/39; 209/40; 209/223.1; 209/232

[58] Field of Search ..... 209/39, 40, 223.1, 232, 209/478

[56] References Cited

U.S. PATENT DOCUMENTS

| | | | |
|---|---|---|---|
| 541,202 | 6/1895 | Glasmann | 209/43 X |
| 1,760,590 | 5/1930 | Fehely et al. | 209/39 |
| 2,733,812 | 2/1956 | Hoff | 209/223.1 |
| 2,801,750 | 8/1957 | Swanson | 209/223.1 |
| 2,919,803 | 1/1960 | Stem | 209/223.1 |
| 2,976,995 | 3/1961 | Forrer | 209/223.1 |
| 3,160,583 | 12/1964 | Stem | 209/223.1 |
| 4,129,498 | 12/1978 | Clark et al. | 209/232 |
| 4,235,710 | 11/1980 | Sun | 209/223.1 |
| 4,303,504 | 12/1981 | Collins | 209/223.1 |
| 4,565,624 | 1/1986 | Martinez | 209/40 |
| 4,659,457 | 4/1987 | Martinez | 209/40 |
| 4,941,969 | 7/1990 | Schönert et al. | 209/39 |

FOREIGN PATENT DOCUMENTS

| | | | |
|---|---|---|---|
| 570016 | 2/1959 | Canada | 209/39 |
| 143967 | 11/1979 | Japan | 209/40 |
| 1005921 | 3/1983 | U.S.S.R. | 209/39 |
| 1565525 | 5/1990 | U.S.S.R. | 209/223.1 |
| 337759 | 4/1929 | United Kingdom | 209/232 |
| 1487429 | 9/1977 | United Kingdom | 209/40 |

*Primary Examiner*—Robert P. Olszewski
*Assistant Examiner*—Steven M. Reiss
*Attorney, Agent, or Firm*—George A. Bode; Michael L. Hoelter

[57] ABSTRACT

A material separator that magnetically separates the desired material from a slurry as the slurry travels along one or more passageways between a hopper and a discharge chute. Riffle lines can also be incorporated in such passageways to increase the separation capabilities of the material separator. Additionally, as the need arises, more or fewer passageways can be added or removed to adjust the collection efficiency of the material separator.

13 Claims, 5 Drawing Sheets

SPECIFIC GRAVITY METAL SEPARATOR

BACKGROUND OF THE INVENTION

1. Field of the Invention

This invention pertains to material separators in general and, more particularly, to a means for magnetically separating precious metals from their ores in slurry form as this slurry flows through a series of passageways.

2. General Background

The art of material separators is redundant with attempts to separate the desired material from its surroundings. In some cases, the material is in dry form and is separated by passing the material through a series of smaller and smaller filters. In other cases, the material is mixed with water (or some other fluid) to form a slurry that is then shaken or vibrated so that the heavier material will settle out while the finer material is flushed from the separator. Still other examples utilize magnets to attract and collect any metal that may exist in the material to be separated.

With respect to this latter magnetic type of separator, perhaps a most typical example is shown in U.S. Pat. No. 4,565,624 to Martinez. Martinez illustrates a series of ramps or trays upon which the dry to-be-separated material flows. Underneath some of these trays are magnetic means energized so as to separate magnetic minerals from the feed material. Other examples of magnetic separators are U.S. Pat. No. 529,340 to Watson, et al., U.S. Pat. No. 471,731 to Freeman, U.S. Pat. No. 317,621 to Butler, and U.S. Pat. No. 4,193,767 to Fipke.

Watson, et al. '340, in FIG. 3, illustrates a belt that conveys the dry material over a series of magnets so that the heavier god and magnetic metals will remain on the belt in order to be discharged into receptacle 21 rather than being carried downwardly in the direction of ARROW "A."

Freeman '731 discloses, in FIG. 5, a magnetic cylinder X' that is rotated adjacent the dry material to be separated so as to remove the fine granulated iron from the remaining particles.

Butler '621 discloses a magnetic cylinder H upon which an ore slurry is deposited so that any iron particles in the slurry will cling to the cylinder and thus be separated from the flowing slurry.

Fipke '767 discloses a method of retrieving desired particles from a bulk sample by first washing and then wet sieving the sample, drying the desired sized sample just obtained, separating this sample by specific gravity and then magnetically separating this separated sample so as to acquire a concentration of the desired material.

While the above disclose several means for the magnetic separation of material, the equipment required for such is cumbersome, bulky and expensive. The methods disclosed for separating a wet slurry specify many pre-separation steps before the slurry can be magnetically separated. These added steps add to the cost and expense of such separation. They also increase the time required to magnetically separate a sample, thereby decreasing the total number of samples that can be separated in a given time frame Another drawback to the above disclosures is that the sample must be delivered to the separating machine rather than the separator being portable enabling it to be transported to the sampling site.

It is thus an object of this invention to provide a portable magnetic separation device that can easily be transported to the sampling site.

Another object of this invention is to reduce or eliminate the many pre-separation steps normally required with other magnetic separators.

Still another object of this invention is to provide a magnetic separator that is not bulky, is not cumbersome, and is not expensive.

A further object of this invention is to provide a means for expanding the capabilities of this magnetic separator so that as the number or size of each sample grows, the size of the separator can grow as well.

An additional object of this invention is to provide a separator that operates quickly and efficiently so as to provide the desired separation in a timely manner.

Yet another object of this invention is to utilize water hydraulic flow characteristics, gravity, and magnetic attraction principles to separate out the desired particles. These and other objects and advantages of this invention will become obvious upon further investigation.

SUMMARY OF THE PRESENT INVENTION

The preferred embodiment of the apparatus of the present invention solves the aforementioned problems in a straightforward and simple manner. What is provided is a material separator for separating the desired material from a slurry including a hopper having an open top and a bottom opening in fluid connection with at least one passageway, but preferably more than one. Each passageway is angled downwardly from the hopper at an angle of about 45 degrees, more or less, from the horizontal with each such passageway including an elongated tray along which the slurry travels. These individual trays include magnetic spoilers that project slightly above the bottom of the tray so as to both magnetically attract the desired particles and to provide a mini-baffle that encourages the heavier particles to settle out. Riffle lines may also be added to the tray to provide additional means for the capture of the desired particles. Upon exiting the passageway, the slurry enters a discharge chute that extends generally vertically upwardly from the bottom of each passageway. This discharge chute also has an open top that terminates at an elevation below the open top of the hopper.

BRIEF DESCRIPTION OF THE DRAWING

For a further understanding of the nature and objects of the present invention, reference should be had to the following description taken in conjunction with the accompanying drawing in which like parts are given like reference numerals and, wherein.

DETAILED DESCRIPTION OF THE PREFERRED EMBODIMENT

Figure 1:
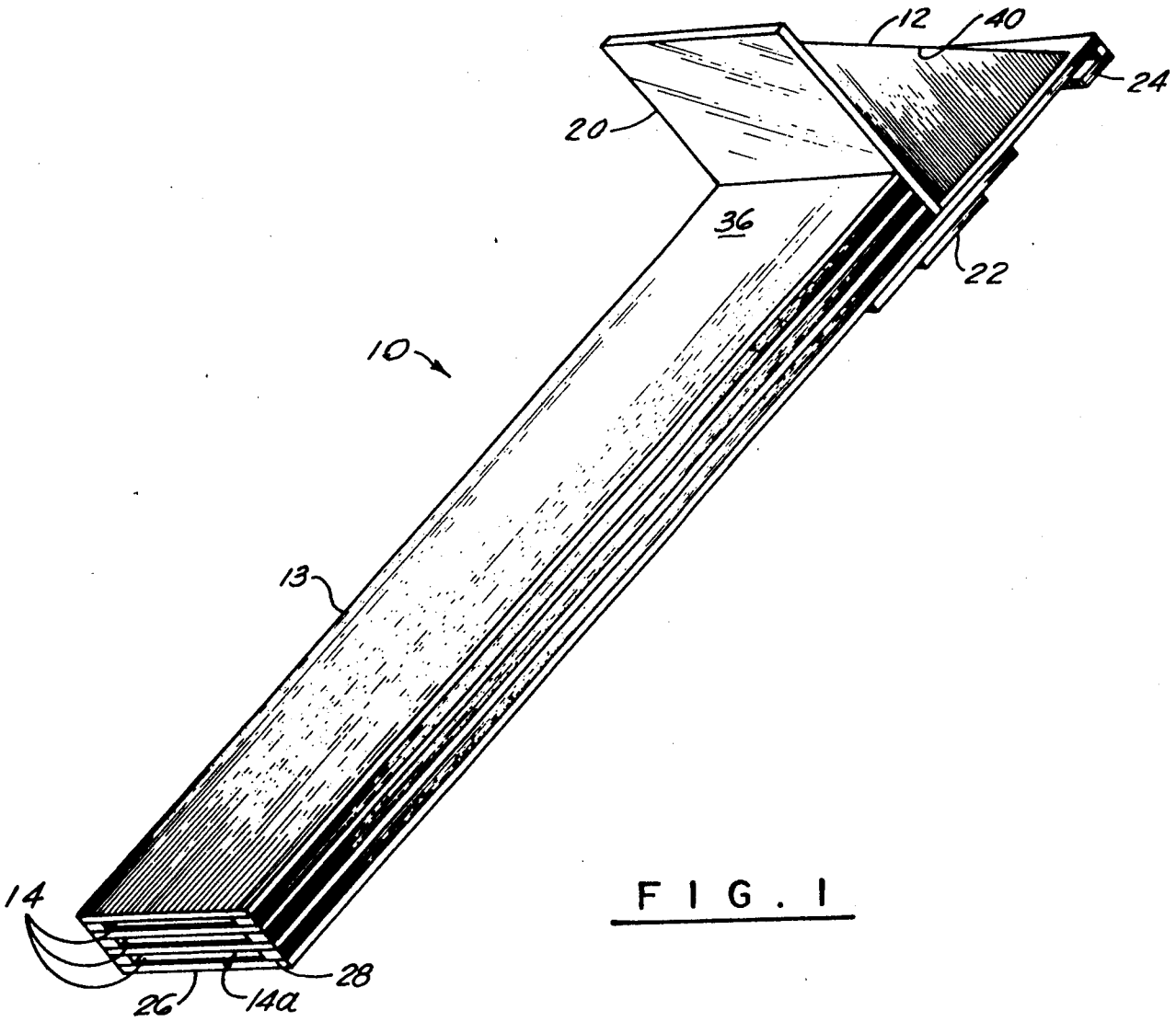
FIG. 1 is a top perspective view of the preferred embodiment of the apparatus of the present invention.
Figure 2:
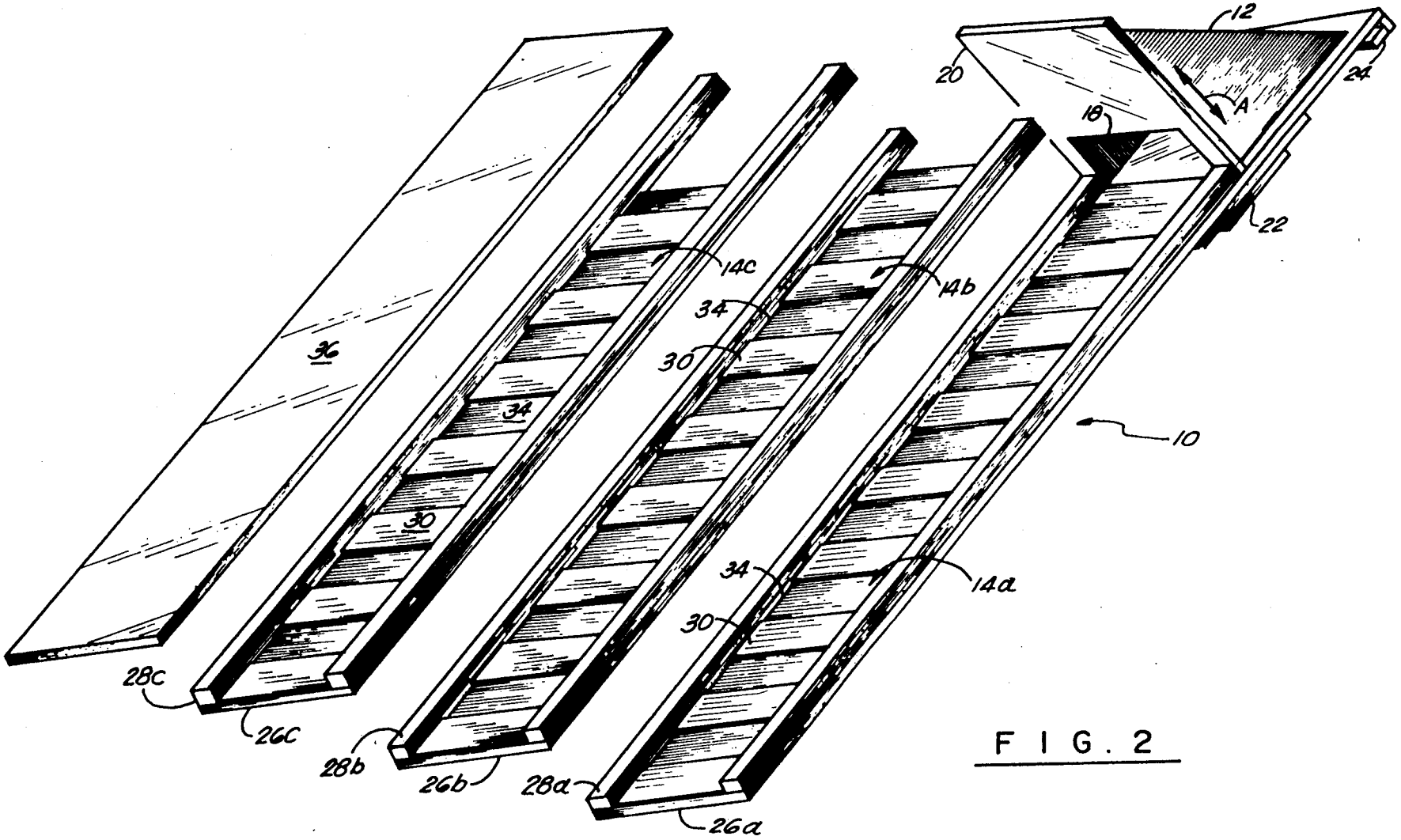
FIG. 2 is an exploded top perspective view of the embodiment of FIG. 1.
Figures 7, 8, 9:
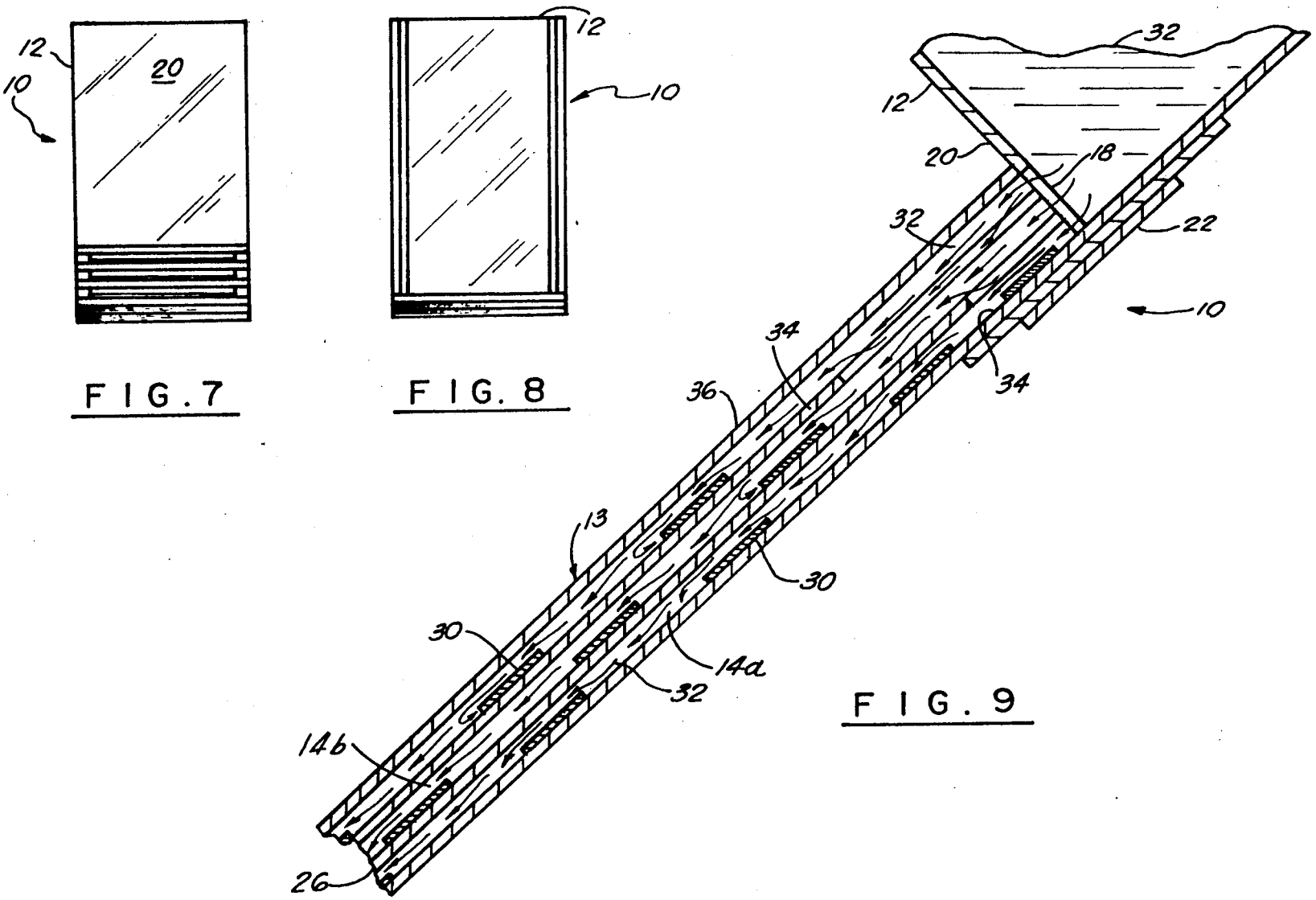
FIG. 7 is a front elevational view of the embodiment of FIG. 1.
FIG. 8 is a rear elevational view of the embodiment of FIG. 1.
FIG. 9 is a side elevational view in cross-section illustrating the operation of the preferred embodiment of FIG. 1; and, FIG. 10 is a side elevational view similar to that of FIG. 9, but including a discharge chute connected thereto.
Figure 10:
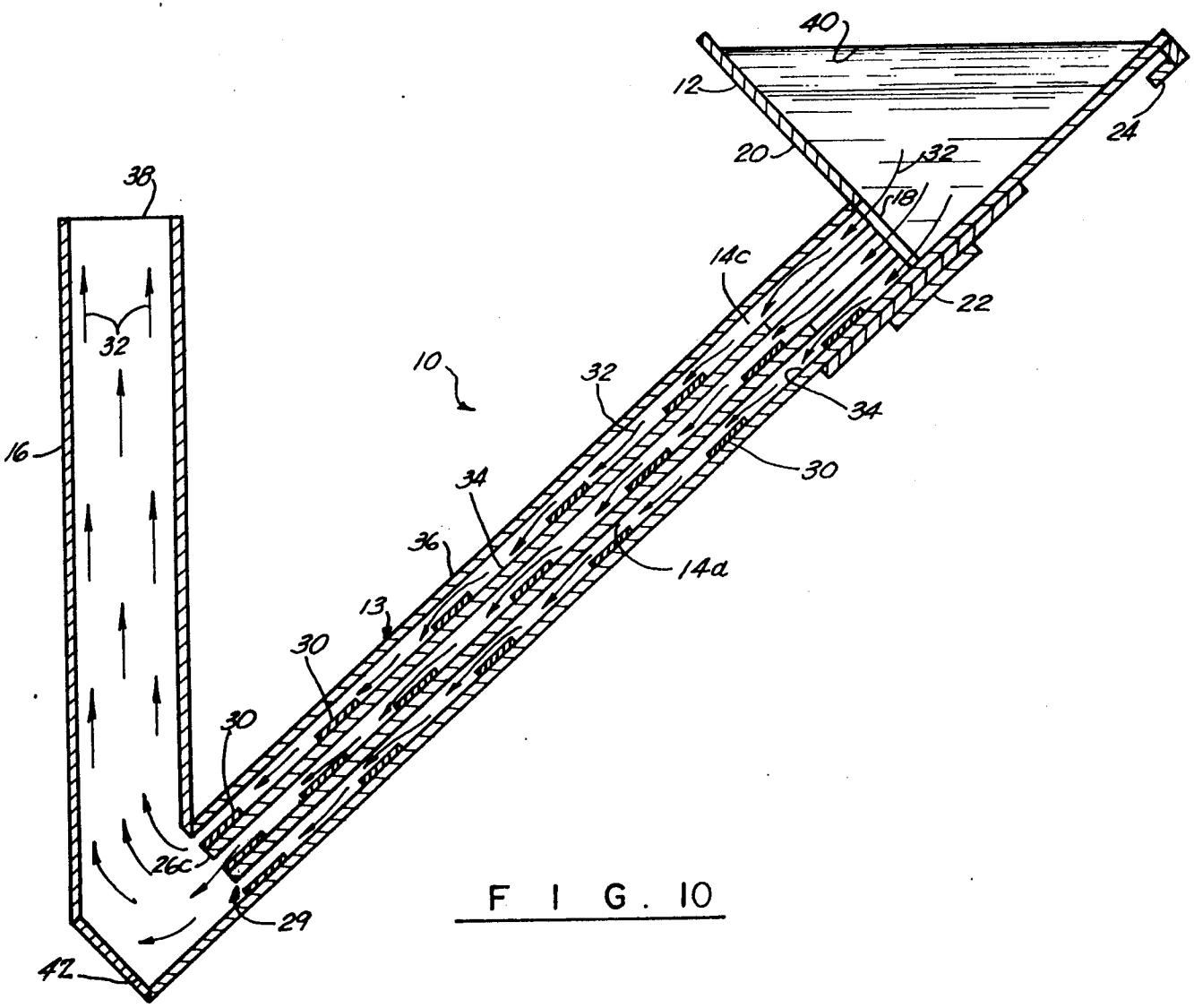

Referring now to the drawings, and in particular FIGS. 1, 2 and 9, the apparatus of the present invention is designated generally by the numeral 10. There is shown material separator 10 which consists of an upper supply hopper 12 in communication with a housing 13 having a plurality of passageways 14 (designated 14*a*, 14*b* and 14*c* in the preferred embodiment) therethrough connected to hopper 12. Through passageways 14 the material to be separated flows. FIG. 10 illustrates discharge chute 16 through which this material may travel after passing through passageways 14.

Separator 10 is generally constructed of thin but stiff water-proof material, such as plexiglass or the like, that is light in weight making separator 10 easily portable. If desired, the various components of separator 10 can be constructed as one entire unit, or separator 10 can be constructed of separate components that are combined or interlocked to form separator 10. Additionally, separator 10 is preferably constructed in such a manner that should more passageways 14 be required, they can be added with little effort or reworking of separator 10. Consequently, it might be desirable to construct hopper 12 with a bottom opening 18 that is adjustable so that hopper 12 can be coupled with the desired number of passageways 14 in a water-tight manner. This can be accomplished by enabling side 20 of hopper 12 to slide up and down (ARROW A in FIG. 2) in a direction perpendicular to passageways 14.

Figures 3, 4, 5, 6:
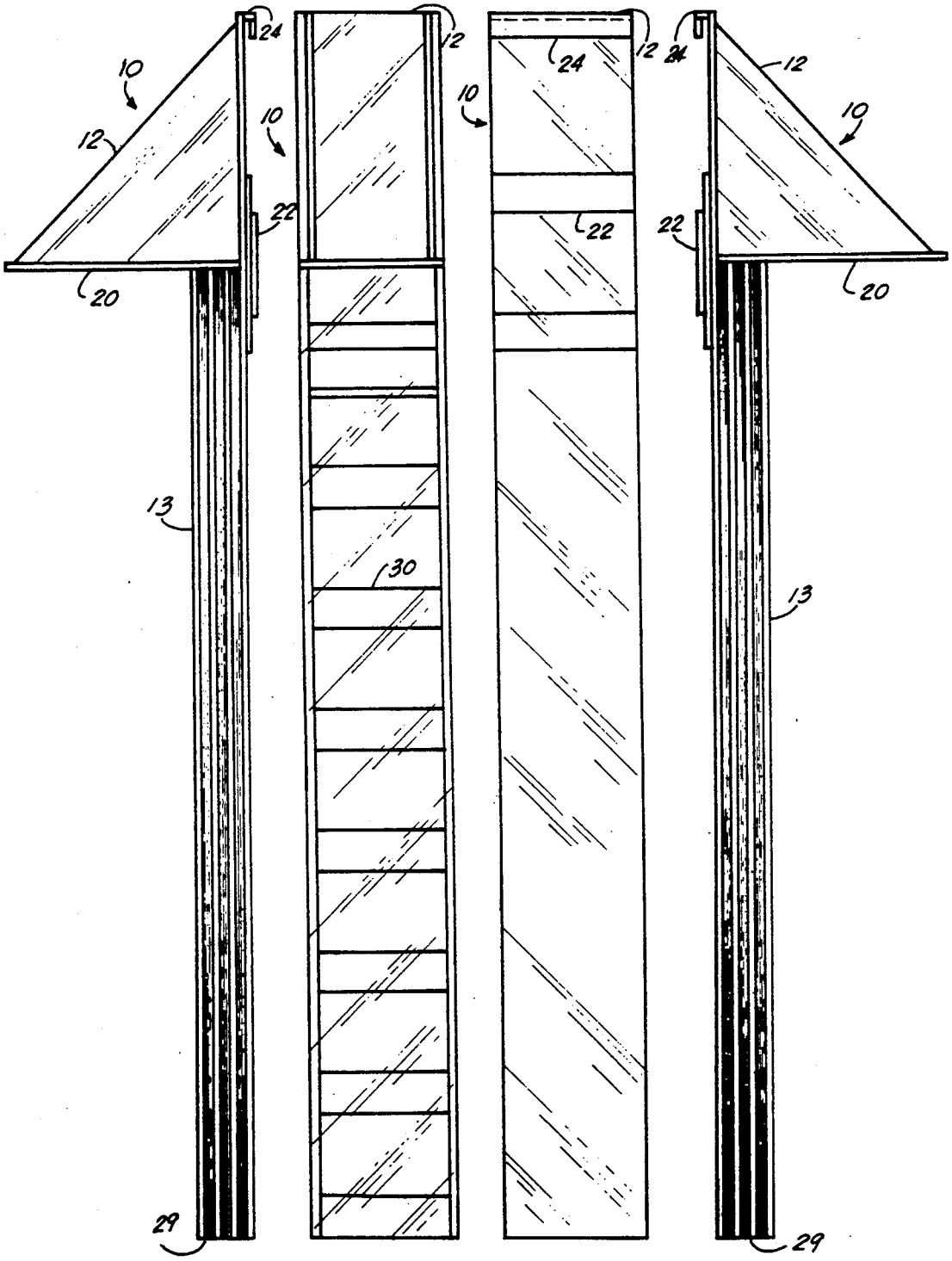
FIG. 3 is a right side elevational view of the embodiment of FIG. 1.
FIG. 4 is top plan view of the embodiment of FIG. 1.
FIG. 5 is a bottom plan view of the embodiment of FIG. 1.
FIG. 6 is a left side elevational view of the embodiment of FIG. 1.

As best shown in the side views of FIGS. 3 and 6, hopper 12 is "V" shaped but this configuration of watertight hopper 12 need not be the only one. The important aspect of hopper 12 is the need for a bottom opening 18 that is in direct communication with passageways 14. If needed or desired, additional strength may be added to this bottom opening region of hopper 12 by the addition of braces or stiffeners 22 to the underneath side of hopper 12 as best shown in FIGS. 1, 2, 3, 5 and 6. Also, a supporting device 24 may be attached to an upper end of one or more of the sides of hopper 12 so that separator 10 may be supported within a larger vessel, should such be desired.

Each passageway 14, as shown in FIG. 2, comprises an elongated tray 26 bounded on opposite sides by coextensive elongated spacers 28. Between spacers 28 and upon tray 26 are placed a series of spaced-apart raised magnetic spoilers or mini-baffles 30 that slow the passage of the to-be-separated material or slurry 32 downwardly along passageway 14 (flow ARROWS of FIGS. 9 and 10). By slowing the flow of slurry 32, spoilers 30 permit any heavy material in slurry 32 to settle out. These spoilers 30 also retain by magnet attraction any magnetic material in slurry 32 in addition to providing a region in front of or behind each spoiler 30 that can be used to collect any heavy material flowing by.

Between these spoilers 30 are provided numerous riffle lines 34 that are provided in and extend across tray 26 parallel to spoilers 30. The purpose of riffle lines 34 is also to slow the passage of slurry 32 within passageway 14 and to provide a place to capture any heavy material within slurry 32. As can be seen from FIG. 2 of the drawings, both spoilers 30 and riffle lines 34 are provided in alternating arrangement along the entire length of tray 26, however, this need not always be the case. In other embodiments, spoilers 30 may be relegated to one region of tray 26 while riffle lines 34 are relegated to another, such as by locating spoilers 30 at the beginning of or entrance to passageways 14 and riffle lines 34 at the exit end.

In any event, as best shown in FIGS. 1, 2, 9 and 10, when more than one passageway 14 is desired, another tray 26*b* is positioned vertically adjacent the first one 26*a*, with tray 26*b* being spaced from this first tray 26 by spacers 28*a*. As indicated in FIGS. 1 and 2, the last of these numerous trays 26*c* is covered with cover 36 thus forming housing 13. Additionally, it should be noted that, as best illustrated in FIGS. 2 and 9, each consecutive tray 26 may begin farther along respective passageway 14, if desired, so as to enable the heavier material to settle out and to aid in the flow of slurry 32 through separator 10. To accomplish this, these Figures illustrate each tray 26 beginning with a riffle line section 34 although it is conceivable to begin each tray 26 with magnetic spoilers 30 or a combination of the two. Furthermore, it is preferable for passageways 14 to extend at an angle of about 45 degrees, more or less, from the horizontal.

Referring now to FIG. 10, there is shown discharge chute 16 connected to the end of passageways 14. As shown, a magnetic spoiler 30 is located at the discharge end 29 of each passageway 14 so as to produce maximum velocity during discharge into discharge chute 16. Discharge chute 16 directs the discharged slurry 32 upwardly towards the open top so that it may exit separator 10. Generally, discharge chute 16 is a vertical column sized to approximately equal the volume of all the passageways 14 assembled together with its exit opening 38 being at an elevation below the top opening 40 of hopper 12. The nearly vertical rise of discharge chute 16 combined with the low flow rate of slurry 32, further assists in the settling out of the heavier components of slurry 32. A heavy waste collection zone 42 is generally configured at the bottom of discharge chute 16 (and may be provided with a removable plug (not shown) at its lowest point) so as to aid in the collection and elimination of these heavier components of slurry 32 from material separator 10.

During operation, separator 10 is partially submerged within a larger vessel containing water or some other fluid, but not so deeply that hopper 12 is likewise submerged. Preferably, the water level outside separator 10 is about equal to the level of bottom opening 18 of hopper 12, more or less. Whatever the water level chosen, discharge chute 16 and passageways 14 would be flooded so as to reduce the flow speed through separator 10 and to encourage material settlement. In this fashion, when hopper 12 is filled with fluid, the pressure head created would equal the height of the fluid within hopper 12.

Due to the pressure head available, the slurry 32 poured into hopper 12 begins its slow descent under this pressure along passageways 14 towards discharge chute 16. As slurry 32 passes each successive magnetic spoiler 30, any magnetic material therein attaches itself to these spoilers 30, thereby causing such material to be separated out. Additionally, the slow descent of slurry 32 also enables any heavy material not previously removed from slurry 32 to collect in front of or behind each spoiler 30, thereby also aiding in the separation process. Riffle lines 34 function similarly in that they also provide an opportunity for any heavy material to become separated from slurry 32.

As slurry 32 completes its journey along passageways 14 and collects within discharge chute 16, it will gradually rise until it overflows discharge chute 16. The heavier material of slurry 32 within discharge chute 16 will settle near the bottom while the lighter material will rise and leave separator 10 so that it may be filtered again if such is desirable. Furthermore, and as can be seen, if the sample size increases, any number of additional passageways 14 can be added to separator 10 as needed. Also, the discharged slurry 32 can be filtered or separated again and again as many times as is desirable.

Separator 10, thus makes use of the magnetic properties and physical characteristics of spoilers 30, of the capturing ability of riffle lines 34, of gravity flow, and of hydraulic pressure to separate slurry 32.

As indicated above, the water level outside separator 10 must be slightly below the slurry level within hopper 12 so that the gradual flow of slurry 32 through passageways 14 will be slow but steady. Should the difference in water level be too great, too much turbulence will be generated within passageways 14, thereby reducing the ability to separate out the desired materials. Ideally, separator 10 will be submerged within a larger vessel with hopper 12 extending slightly above the water level within this vessel. Furthermore, discharge chute 16 must not extend upwardly above the level of the slurry within hopper 12 otherwise there will be no flow through passageways 14. Thus, as can be seen, the flow through passageways 14 is dependant upon the water level within hopper 12 being at an elevation above that of the body of water surrounding separator 10.

During operation, slurry 32 travels downwardly through passageways 14 at a approximately 45 degree (more or less) angle making contact with spoilers 30 and riffle lines 34. These devices allow the desired metals to naturally settle both in front of and behind such spoilers 30 and riffle lines 34 with a continuous flushing of the lighter waste material from separator 10. Any magnetic particles within slurry 32 become attached to the surface of magnetic spoilers 30, thereby providing a settlement and trapping zone for these finer heavy metal particles.

As stated above, fluid flow through separator 10 is determined by head pressure, and the particle size generally determines the desired slurry velocity.

Because many varying and differing embodiments may be made within the scope of the inventive concept herein taught and because many modifications may be made in the embodiment herein detailed in accordance with the descriptive requirement of the law, it is to be understood that the details herein are to be interpreted as illustrative and not in a limiting sense.

What is claimed as invention is:

1. A material separator for separating desired material from a slurry comprising:

(a) a hopper having an open top and a bottom opening therein;

(b) at least one passageway in fluid connection with said bottom opening, each said passageway being angled downwardly from said bottom opening and comprising an elongated tray along which the to-be-separated slurry flows, said tray further comprising magnetic separator means for separating and collecting the desired material from said slurry, said magnetic separator means comprising a plurality of spaced apart magnetic spoilers projecting slightly above said tray and extending transverse to the direction of flow of said slurry along said tray; and, (c) a discharge chute, secured to the end region of each said passageway and extending upwardly from said end region, said discharge chute being open at the top and terminating at an elevation below said open top of said hopper.

2. The apparatus as set forth in claim 1, wherein said passageways extend at an angle of about 45 degrees from said hopper.

3. The apparatus as set forth in claim 1, further comprising riffle lines provided in said tray for further separation and collection of the desired material.

4. The apparatus as set forth in claim 3, wherein said riffle lines extend in said transverse direction intermediate said magnetic spoilers.

5. The apparatus as set forth in claim 3, wherein additional passageways may be selectively added to the material separator or said passageways may be selectively removed from the material separator as needed.

6. The apparatus as set forth in claim 3, wherein said discharge chute comprises a column that projects generally vertically upwardly from said end region of said passageways.

7. The apparatus as set forth in claim 6, wherein the trays of said passageways are staggered in relation to said bottom opening of said hopper.

8. A method of magnetically separating desired material from a slurry comprising the steps of:

(a) filling a hopper having an open top with a slurry;

(b) passing said slurry along at least one passageway in fluid connection with said hopper;

(c) separating said slurry within said passageway by passing said slurry over a series of spaced apart magnetic spoilers projecting slightly above the bottom of said passageway; and, (d) discharging the slurry from said passageway into a discharge chute, said discharge chute projecting generally upwardly from said passageway and having an open top at an elevation below that of said hopper.

9. The method as set forth in claim 8, wherein said passageway extends at an angle of about 45 degrees from said hopper.

10. The method as set forth in claim 9, further providing riffle lines in said passageway for further separation and collection of the desired material.

11. The method as set forth in claim 10, wherein said riffle lines extend transversely within said passageway and are positioned intermediate said magnetic spoilers.

12. The method as set forth in claim 10, wherein additional passageways may be selectively added to the material separator or said passageways may be selectively removed from the material separator.

13. The method as set forth in claim 13, wherein said passageways are staggered in relation to said bottom opening of said hopper.

* * * * *